US006176411B1

(12) United States Patent
Suketomo

(10) Patent No.: US 6,176,411 B1
(45) Date of Patent: Jan. 23, 2001

(54) PAPER TRANSFER APPARATUS

(75) Inventor: Seiji Suketomo, Hyogo (JP)

(73) Assignee: Fujitsu Limited, Kawasaki (JP)

( * ) Notice: Under 35 U.S.C. 154(b), the term of this patent shall be extended for 0 days.

(21) Appl. No.: 09/172,664

(22) Filed: Oct. 15, 1998

(30) Foreign Application Priority Data

Jun. 1, 1998 (JP) ..... 10-151090

(51) Int. Cl.[7] ..... B65H 20/20; B65H 23/10
(52) U.S. Cl. ..... 226/59; 226/74; 226/195
(58) Field of Search ..... 226/59, 74, 75, 226/195

(56) References Cited

U.S. PATENT DOCUMENTS 3,917,048 * 11/1975 Riley ..... 226/195
4,000,803 * 1/1977 Warp et al. ..... 226/195
5,061,096 * 10/1991 Hauslaib et al. ..... 226/74
5,188,269 * 2/1993 Nakano ..... 226/74
5,595,334 * 1/1997 Belec et al. ..... 226/74

* cited by examiner

*Primary Examiner*—John M. Jillions
(74) *Attorney, Agent, or Firm*—Armstrong, Westerman, Hattori, McLeland & Naughton

(57) ABSTRACT

A paper transfer apparatus is provided which is incorporated in an electrophotographic printer having a photosensitive drum for printing on elongated paper. The paper transfer apparatus serves to transfer the elongated paper along a transfer path extending via the photosensitive drum. The paper transfer apparatus includes a discharge or scuff roller for pulling the elongated paper in a transferring direction. The discharge roller is spaced downstream from the photosensitive drum. The paper transfer apparatus also includes a pair of tractors for advancing the elongated paper along the transfer path. The tractors are spaced upstream from the photosensitive drum. Each of the tractors is provided with a presser member supported by a tractor lid of the tractor. The presser member serves to apply friction to the elongated paper when the tractor lid is in closed position.

8 Claims, 9 Drawing Sheets

PAPER TRANSFER APPARATUS

BACKGROUND OF THE INVENTION

1. Field of the Invention

The present invention relates to a paper transfer apparatus incorporated in an electrophotographic printer used for printing selected images on elongated paper.

2. Description of the Related Art

To describe the overall arrangements of a typical paper transfer apparatus, reference is first made to FIG. 1 of the accompanying drawings. As shown in FIG. 1, a paper transfer apparatus may include a paper hopper 11, a pair of paper tractors 2 (only one is shown), a photosensitive drum 12, an image transferring unit 13, a discharge or scuff roller 16, a pinch roller 17 and a paper stacker 18.

The paper hopper 11 accommodates elongated paper P in an alternately folded manner. The elongated paper is formed with a series of feed holes arranged along each longitudinal edge of the paper. After being pulled out from the paper hopper 11, the paper P is brought into engagement with the tractors 2. The two tractors 2 are spaced from each other by a predetermined distance in a widthwise direction of the elongated paper P. Each of the tractors 2 includes an endless belt 21 formed with a plurality of projections 22. In operation, these projections come into engagement with the feed holes of the paper P. Thus, when the endless belts 21 are rotated, the paper P is caused to advance along a transfer path.

The photosensitive drum 12 has a cylindrical side surface on which electrostatic latent images are produced by an electrostatic latent image forming unit 14. Thus produced latent images are made visible or developed by a developing unit 15. Specifically, the latent images on the photosensitive drum 12 are changed to toner images by the developing unit. Then, the toner images are transferred onto the paper P by the transferring unit 13. Thereafter, the transferred toner images are thermally fixed to the paper by an image fixing unit 19. Then, the paper P, held between the discharge roller 16 and the pinch roller 17, is moved further along the transfer path. Finally, the paper P is received in the stacker 18 in an alternatively folded manner.

For performing high-quality printing, the transferring operation for the elongated paper needs to be synchronized to the rotation of the photosensitive drum 12. For attaining such synchronous operation, according to the arrangements shown in FIG. 1, use is made of the tractors 2 and the discharge roller 16 associated with the pinch roller 17. The tractors 2, arranged at an upstream point of the transfer path, are capable of moving the elongated paper at a rate equal to the peripheral speed of the photosensitive drum 12 rotated. The discharge roller 16 together with the pinch roller 17, arranged at a downstream point of the transfer path, is capable of applying a pulling force to the paper P in the transferring direction. For generating appropriate tension in the elongated paper P located between the tractors 2 and the discharge roller 16, the discharge roller 16 is caused to rotate at a rate greater than the predetermined transfer speed of the paper P (i.e., the peripheral speed of the photosensitive drum).

A conventional electrophotographic printer incorporating a paper transfer apparatus having the above arrangements has been found disadvantageous in the following points.

Specifically, as the thickness of the elongated paper used for a conventional printer is reduced, the feed holes of the paper tend to be more easily broken when the paper goes through the tractors 2. Even if such a breakage does not occur, the paper may be prematurely jerked out of engagement with the tractors 2. These anomalies will lead to defective printing results such as images printed at unintended locations on the paper.

The inventor of the present invention has found out that the above anomalies are caused by the following phenomena. First, as the thickness of the paper becomes smaller, the paper will be more strongly attached to the photosensitive drum 12 due to the corona discharge occurring at the time of image transfer. Second, as the rotational speed of the photosensitive drum 12 is increased for enabling more effective printing, it becomes harder for the elongated paper to be detached from the photosensitive drum 12 after the developed images are transferred onto the paper. This is because sufficient air cannot flow in between the photosensitive drum 12 and the paper as the rotational speed of the photosensitive drum is increased. As a result, even after the image transfer is finished, the paper is not detached immediately but will remain to be attached to the photosensitive drum for a while, as shown in FIG. 8. This means that the elongated paper is forced to move downstream to a greater extent than is originally expected. In such an instance, the feed holes of the paper may be broken or the paper may prematurely come out of engagement with the tractors 2, as stated above.

SUMMARY OF THE INVENTION

It is, therefore, an object of the present invention to provide a paper transfer apparatus capable of overcoming the disadvantages described above.

According to the present invention, there is provided a paper transfer apparatus incorporated in an electrophotographic printer having a photosensitive drum for printing on elongated paper transferred along a transfer path extending via the photosensitive drum, the paper transfer apparatus comprising:

a discharge roller for pulling the elongated paper in a transferring direction, the discharge roller being spaced downstream from the photosensitive drum; and a traction mechanism for advancing the elongated paper along the transfer path, the traction mechanism being spaced upstream from the photosensitive drum;

wherein the traction mechanism is provided with braking means for applying friction to the elongated paper.

As previously stated, since the elongated paper is forcefully pulled in the transferring direction, the feed holes of the paper may be broken, or the paper may unduly come off the traction mechanism without taking any countermeasures. However, according to the present invention, use is made of a traction mechanism provided with braking means for applying friction to the elongated paper. By canceling out the forced pull with the friction, it is possible to prevent the feed holes of the paper from being broken or to prevent the paper from being unduly brought out of engagement with the traction mechanism. As a result, anomalies such as positionally improper printing is advantageously avoided even when relatively thin paper is used. Here, it should be noted that when the friction applied by the braking means is adjusted to be equal to the forced pull, the friction does not interfere with-the normal operation of the traction mechanism.

According to a preferred embodiment, the traction mechanism comprises at least one tractor which includes: a support base provided with an upper surface for supporting the elongated paper; a front and a rear pulleys rotatably supported by the support base; an endless belt held in engagement with the front and the rear pulleys, the endless belt being provided with a plurality of projections coming into engagement with feed holes of the elongated paper; and a tractor lid pivotably supported by the support base, the tractor lid being pivotable between an open position where the endless belt is exposed and a closed position where the tractor lid is held in facing relation to the endless belt; and wherein the braking means comprises a presser member supported by the tractor lid, the presser member being arranged to apply a predetermined pressing force to the elongated paper when the tractor lid is in the closed position.

Conventionally, use has been made of a tractor lid. However, the conventional tractor lid is used only for preventing recording paper from prematurely coming out of engagement with the tractors, but has never been used for supplying friction to the paper. It should be noted that such a friction supply arrangement has conventionally been regarded as a mere hindrance to the normal operation of the tractors, providing no advantage.

According to the preferred embodiment, the friction supply arrangement may be realized by simply attaching a presser member to the tractor lid.

The predetermined pressing force may be caused by a weight of the tractor lid itself. Alternatively, use may be made of an elastic member bridging between the support base and the tractor lid. In such an instance, the predetermined pressing force is caused by the restoring force of the elastic member (and the weight of the tractor lid). The elastic member may be a spring. Instead of the elastic member, the tractor may comprise at least one magnet embedded therein. In such an instance, a magnet may be arranged in the tractor lid, whereas a magnetic metal such as iron or another magnet may be provided in the support base. The magnet may be an electromagnet, so that the magnetic force (hence, the pressing force to the paper) is easily adjusted.

Preferably, the presser member may be formed separately from the tractor lid. With such an arrangement, only the presser member may be made of a wear-resistant material.

Advantageously, the presser member may be adjustable in position with respect to the tractor lid. To this end, the presser member may be attached to the tractor lid by a screw.

Preferably, the traction mechanism may comprise a first and a second tractors each including: a support base provided with an upper surface for supporting the elongated paper; a front and a rear pulleys rotatably supported by the support base; an endless belt held in engagement with the front and the rear pulleys, the endless belt being provided with a plurality of projections coming into engagement with feed holes of the elongated paper; and a tractor lid pivotably supported by the support base, the tractor lid being pivotable between an open position where the endless belt is exposed and a closed position where the tractor lid is held in facing relation to the endless belt;

wherein the braking means comprises a first and a second presser members supported by the tractor lids of the first and second tractors, respectively, the first and second presser members being arranged to apply a predetermined pressing force to the elongated paper when the tractor lids are in the closed position; and wherein each of the first and the second presser members is formed with a plurality of grooves each having an inner end and an outer end opposite to the inner end, the inner end being closer to the other presser member than the outer end, the outer end being offset in the transferring direction with respect to the inner end.

The grooves of the first and the second presser members may be replaced with projections extending in parallel to each other.

With such an arrangement, the paper transferred in contact with the grooves or projections is properly stretched widthwise of the paper. As a result, the paper comes into proper contact with the photosensitive drum, whereby high-quality printing results are obtained.

Other features and advantages of the present invention should become clear from the detailed description to be made hereinafter referring to the accompanied drawings.

DETAILED DESCRIPTION OF THE PREFERRED EMBODIMENT

The preferred embodiments of the present invention will be specifically described below with reference to the accompanying drawings.

Figure 1:
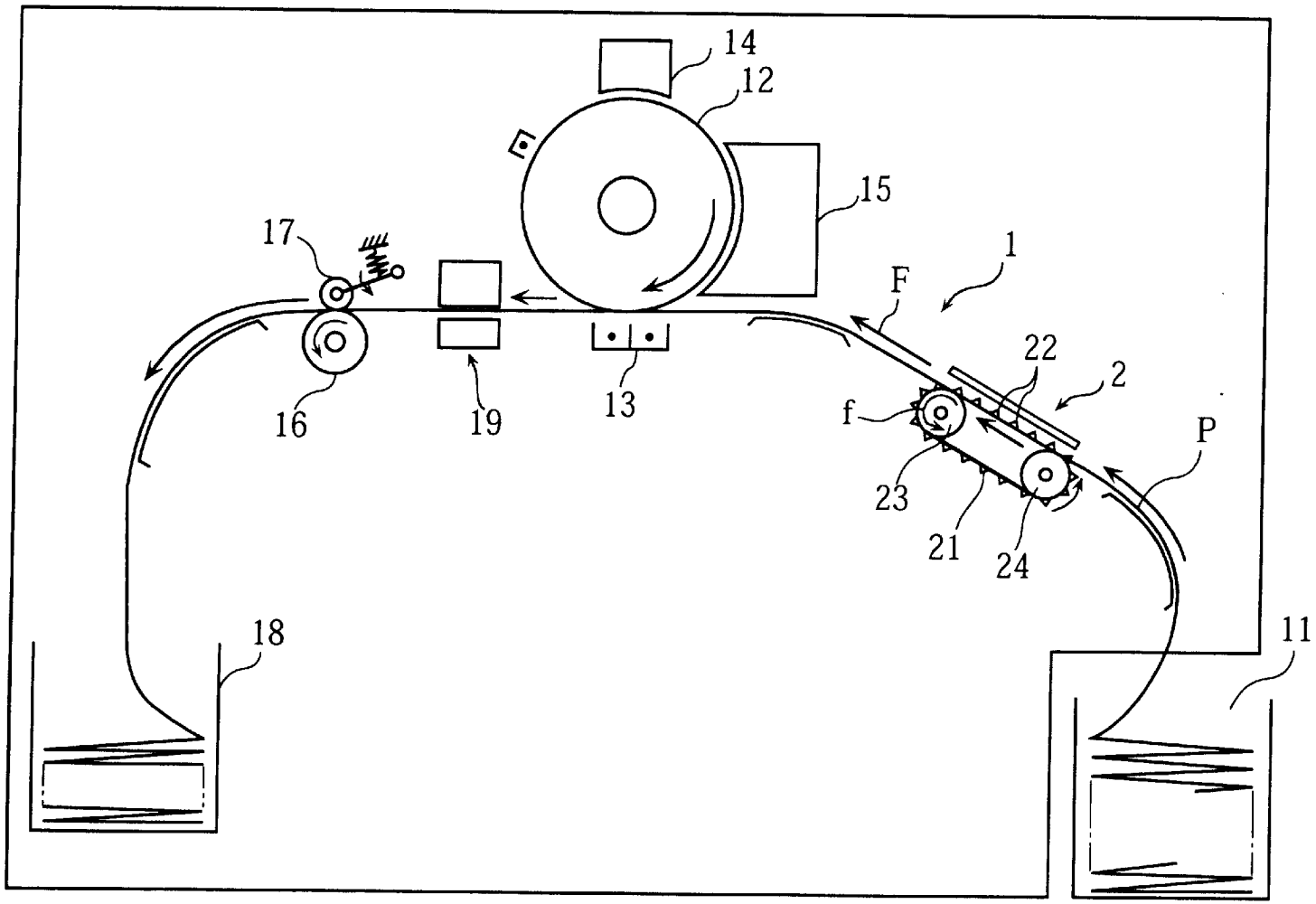
FIG. 1 is a side view schematically showing an electrophotographic printer incorporating a paper transfer apparatus embodying the present invention.

FIG. 1 shows principal parts of an electrophotographic printer incorporating a paper transfer apparatus 1 according to the present invention. The illustrated printer includes a paper hopper 11 for accommodating elongated recording paper P in an alternately folded manner. The elongated paper, having two longitudinal edges extending in parallel to each other, is formed with a plurality of feed holes Pa arranged along each of the longitudinal edges (see FIG. 2). After pulled out from the paper hopper 11, the paper P is brought into engagement with a traction mechanism including a pair of tractors 2. The two tractors 2 are spaced from each other by a predetermined distance corresponding to the width of the elongated paper P. Each of the tractors 2 is provided with an endless belt 21 formed with a plurality of projections 22. In operation, these projections come into engagement with the feed holes of the paper P. Thus, as the endless belts 21 are rotated, the paper P is caused to advance along a transfer path.

The printer also includes a photosensitive drum 12 provided with a cylindrical side surface on which electrostatic latent images are produced by an electrostatic latent image forming unit 14. Thus produced latent images are developed by a developing unit 15. As a result, visible toner images appear on the side surface of the drum 12. Then, the toner images are transferred onto the paper P by a transferring unit 13. Thereafter, the transferred toner images are heated by an image fixing unit 19, so that the images are fixed to the paper P. Then, the paper P, held between a discharge or scuff roller 16 and a pinch roller 17, is moved further along the transfer path. Finally, the paper P is received in a paper stacker 18 in an alternatively folded manner.

As can be understood from the above description, the elongated paper P is moved by the discharge roller 16 (and the pinch roller 17) arranged downstream from the photosensitive drum 12 as well as by the tractors 2 arranged upstream from the drum. The endless belts 21 of the respective tractors 2 are caused to rotate in synchronism with the photosensitive drum 12, so that the elongated paper P is transferred at the same speed as the peripheral speed of the photosensitive drum 12. On the other hand, the peripheral speed of the discharge roller 16 is rendered greater than the transfer speed of the paper P. The discharge roller 16 is held in sliding contact with the paper P. Thus, in operation, the paper P is constantly pulled in a transferring direction F by the discharge roller 16. As a result, appropriate tension is applied to the paper P located between the discharge roller 16 and the tractors 2, thereby properly stretching the paper longitudinally thereof.

Figure 2:
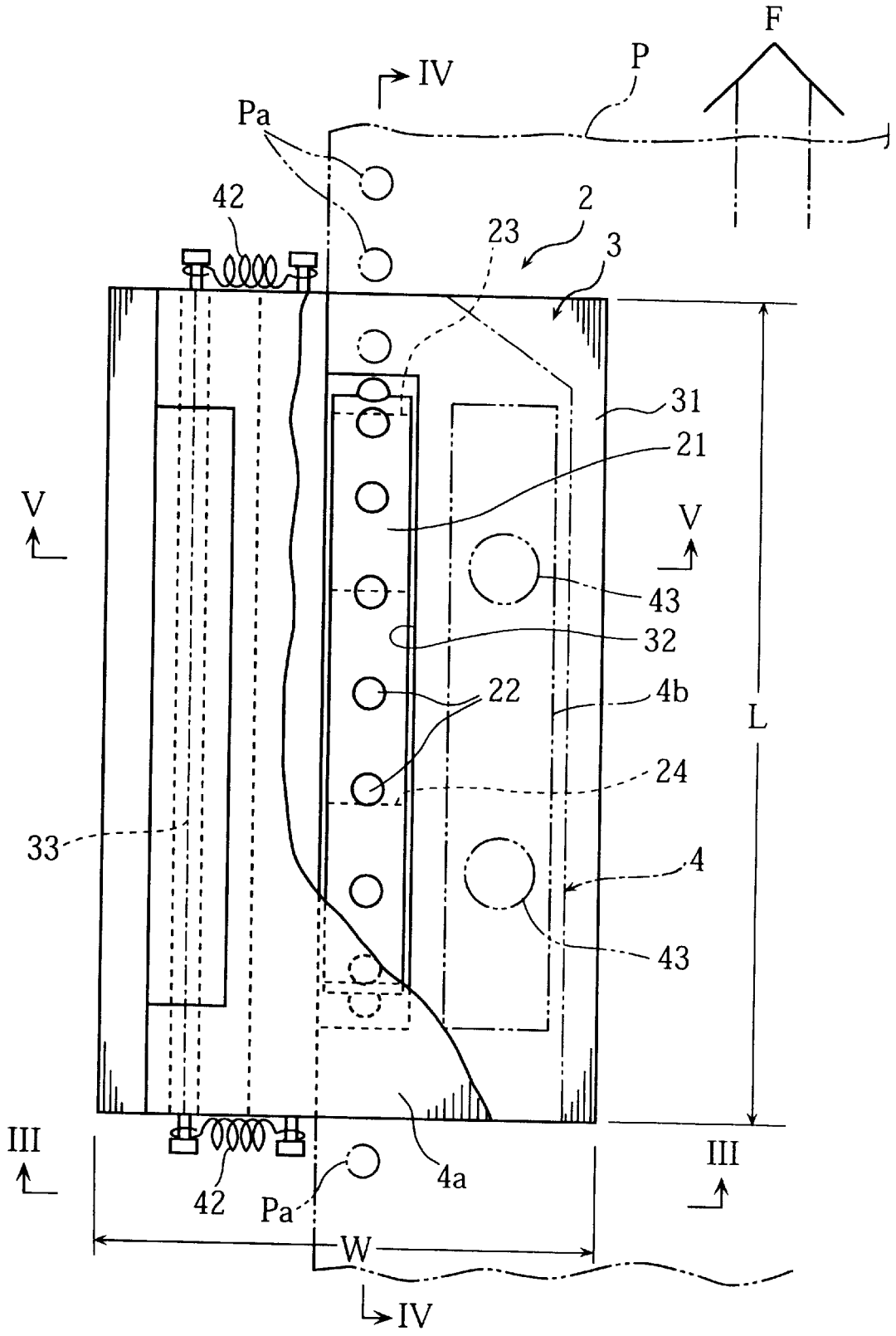
FIG. 2 is a plan view showing a left-hand tractor of two tractors used in the paper transfer apparatus.

FIG. 2 is a plan view showing one of the tractors 2 arranged on the left side (as seen in the transferring direction F) of the paper P. Though not shown, the other tractor 2 is arranged on the right side of the paper P.

Figure 3A:
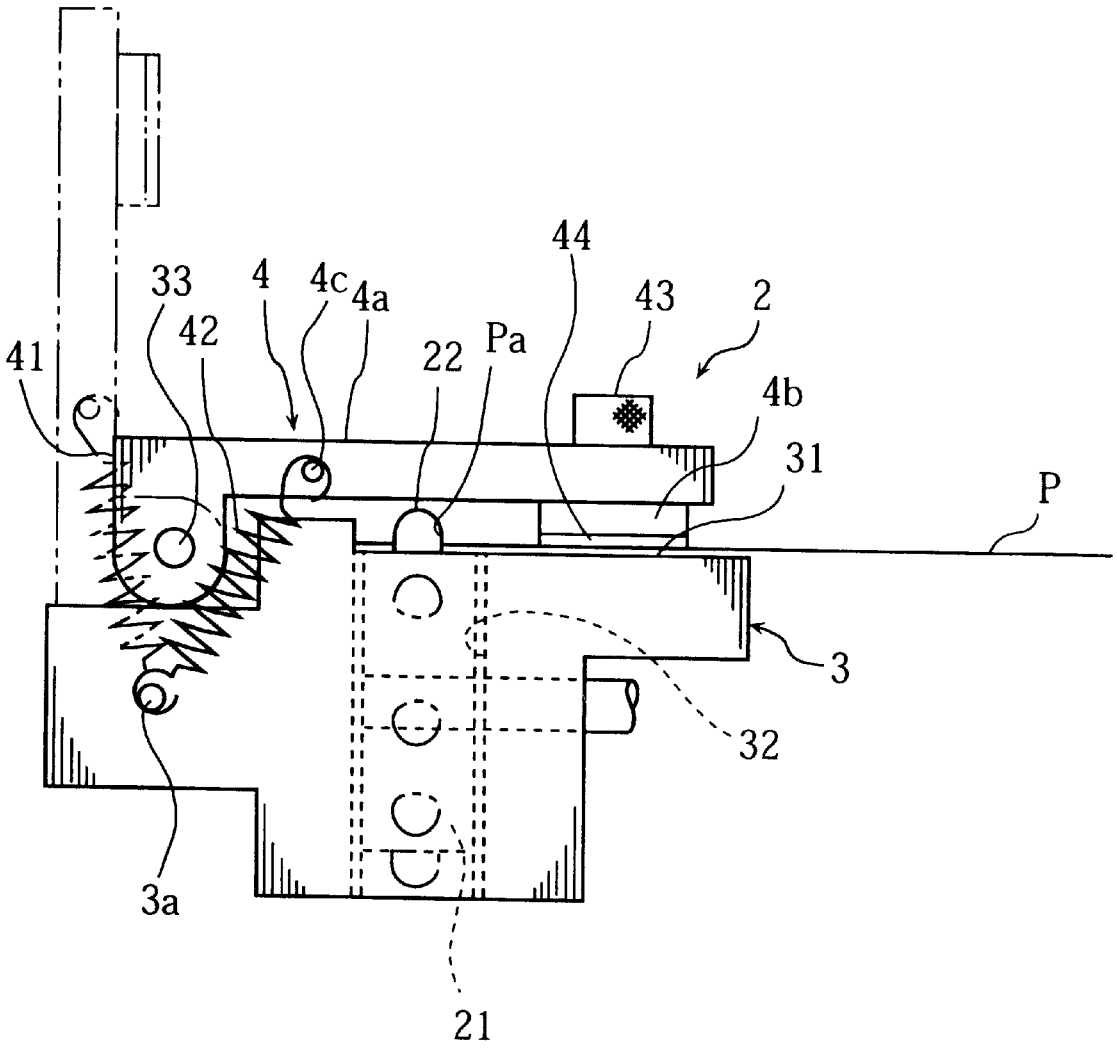
FIG. 3A is a sectional view taken along lines III—III in FIG. 2.

The illustrated tractor 2 includes a support base 3 provided with an upper surface 31 for supporting the paper P. The endless belt 21 is supported by the support base 3. The tractor 2 also includes a tractor lid 4 pivotably supported by the support base 3. As best shown in FIG. 3A, the tractor lid 4 is pivotable about a shaft 33.

As shown in FIG. 2, the support base 3 has a predetermined length L and a predetermined width W. The paper supporting surface 31, having the same length L but a smaller width, is offset inwardly (to the right in FIG. 2) of the support base 3. The support base 3 is formed with a slit 32 vertically extending through the support base. As illustrated, the slit 32 is offset outwardly in the paper supporting surface 31.

Figure 4:
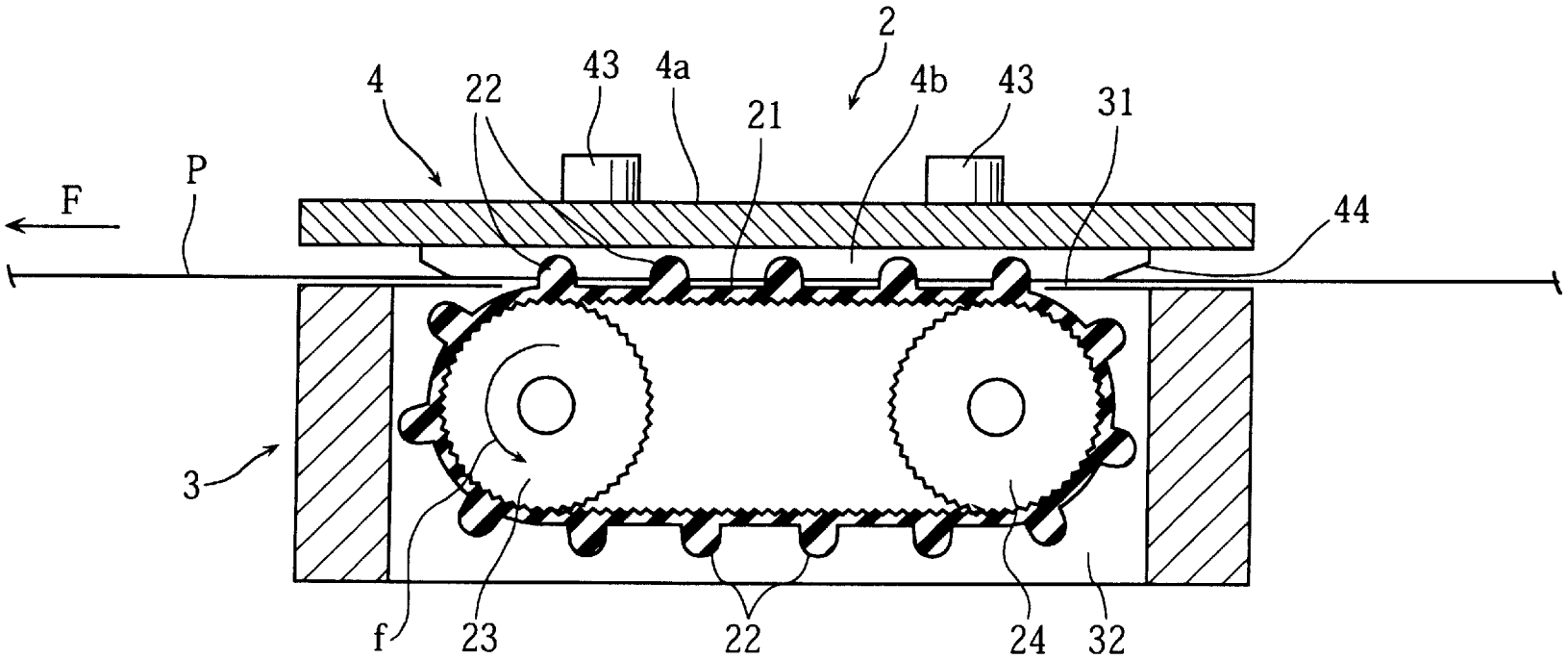
FIG. 4 is a sectional view taken along lines IV—IV in FIG. 2.
Figure 5:
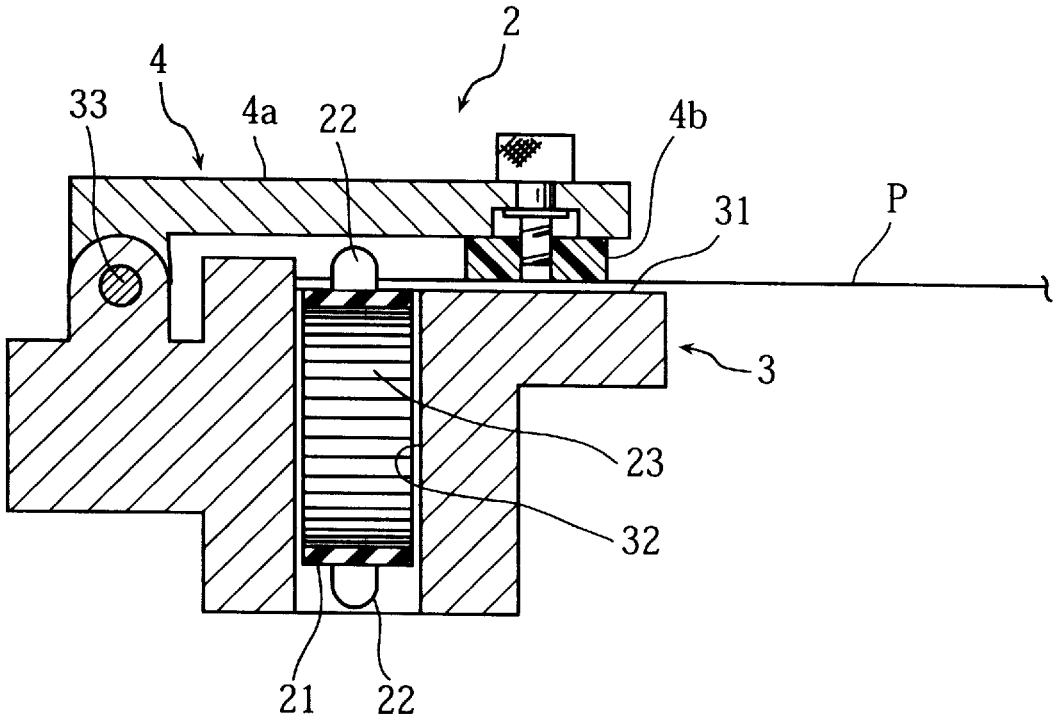
FIG. 5 is a sectional view taken along lines V—V in FIG. 2.

The endless belt 21 is accommodated in the slit 32. The projections 22 formed on the endless belt are equally spaced from each other by a pitch equal to the pitch between adjacent feed holes Pa of the elongated paper P. As shown in FIG. 4, the endless belt 21 internally comes into engagement with a front pulley 23 and a rear pulley 24 both of which are rotatably supported by the support base 3. Each of the pulleys 23, 24 is formed with a plurality of teeth arranged circumferentially, while the endless belt 21 is formed with a plurality of teeth on the inner surface of the belt. In this arrangement, it is possible to prevent the endless belt 21 from slipping on the pulleys 23, 24. The pulleys 23, 24 are arranged so that the upper surface of the endless belt 21 is substantially flush with the paper supporting surface 31. In operation, one of the two pulleys 23, 24 (preferably the front pulley 23) is caused to rotate in a direction shown by an arrow (f) by a suitable driving mechanism (not shown).

As shown in FIG. 3A, the tractor lid 4 is movable between an open position shown in double-dot chain lines and a closed position shown in solid lines. When brought into the open position, a stopper surface 41 of the tractor lid 4 is held in contact with the support base 3. In this way, the tractor lid 4 is prevented from pivoting counterclockwise beyond the open position. In the closed position, the tractor lid 4 substantially comes into contact with the paper supporting surface 31 of the support base 3. Thus, the tractor lid 4 is prevented from pivoting clockwise beyond the closed position. The tractor lid 4 is connected to the support base 3 by a spring 42. Specifically, a lower end of the spring 42 is caught by a projection 3*a* of the support base 3 that is located under the shaft 33, whereas an upper end of the spring 42 is caught by a projection 4*c* of the tractor lid 4 that is offset inwardly (to the right in FIG. 3A) from the shaft 33 when the tractor lid 4 is in the closed position. With such an arrangement, when the tractor lid 4 is in the closed position, the lid is urged toward the paper supporting surface 31. When the tractor lid 4 is in the open position, the spring 42 urges the lid 4 counterclockwise, so that the lid 4 is stably held in the open position.

Figure 6:
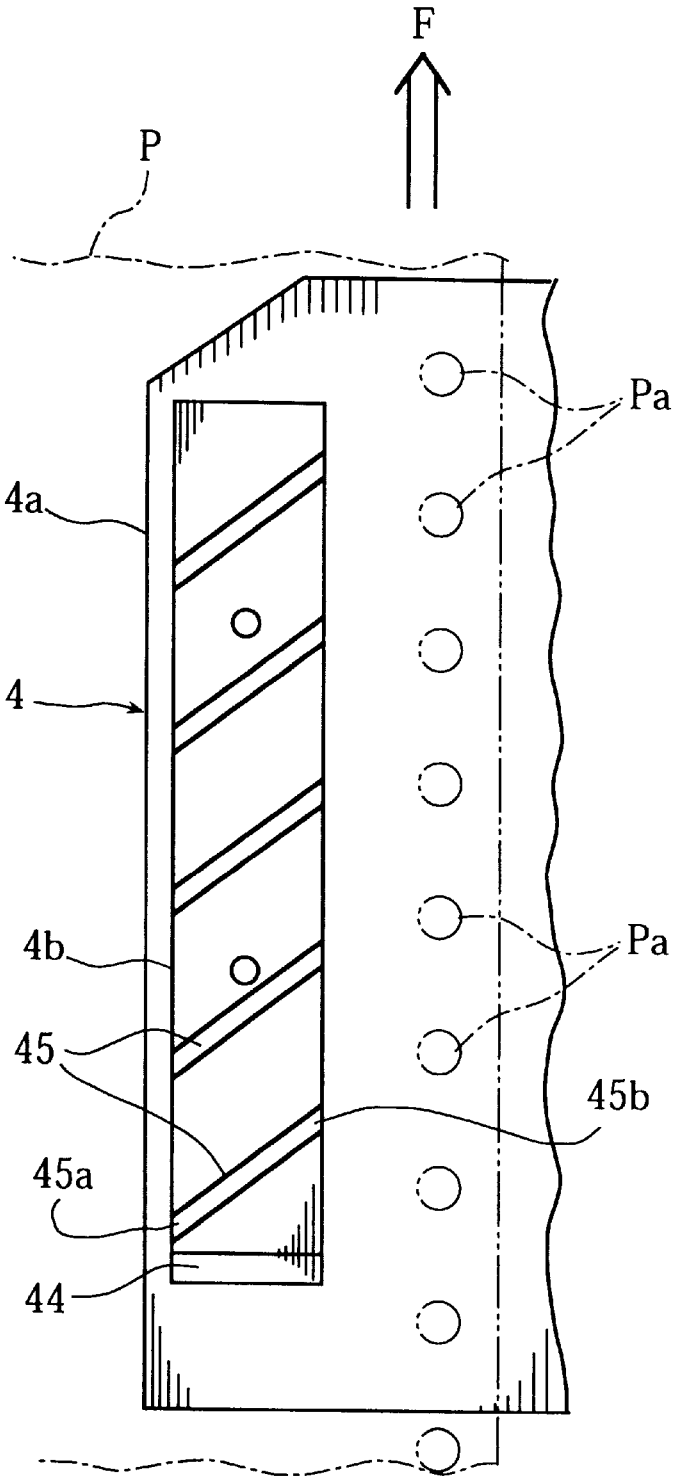
FIG. 6 is a bottom view showing the tractor lid.

The tractor lid 4 of the illustrated embodiment is made up of a lid body 4*a* directly supported by the support base 3, and a presser member 4*b* attached to the lower surface of the lid body 4*a*. The presser member 4*b* is connected to the lid body 4*a* by screwing means 43 (see FIGS. 2–5), so that the presser member is adjustable in protruding amount with respect to the lid body 4*a*. The presser member 4*b* has a lower surface to come into direct contact with the paper P. The lower surface of the presser member 4*b* may be made of a hard resin having sufficient wear resistance. As best shown in FIGS. 3A and 4, the upstream end of the presser member 4*b* is provided with a chamfered portion 44, thereby preventing the transferred paper P from being caught by the presser member. Further, as shown in FIG. 6, the lower surface of the presser member 4*b* is formed with a plurality of grooves 45 extending in parallel to each other. Each of the grooves 45 has an inner end 45*a* and an outer end 45*b*. As illustrated, the outer end 45*b* is offset in the transferring direction F with respect to the inner end 45*a*. The technical significance of this arrangement will be described later.

The initial setting of the elongated paper P is performed in the following manner. First, the tractor lid 4 is brought into the open position (double-dot chain lines in FIG. 3A). Then, a suitable length of the elongated paper P is manually paid out from the paper hopper 11, and the feed holes Pa in the free end portion (leading portion) of the paper P are brought into engagement with the projections 22 of the tractors 2. Finally, the tractor lid 4 is brought into the closed position (solid lines in FIG. 3A).

The lid 4 when closed is located above the endless belt 21. In this way, the paper P is prevented from prematurely coming out of engagement with the projections 22. Further, according to the present invention, the tractor lid 4, when held in the closed position, will urge the paper P toward the paper supporting surface 31. This means that the tractor 2, which serves to advance the paper P, also applies a braking force to the paper P in the direction opposite to the transferring direction F.

When the transfer apparatus is actuated after the initial setting of the paper P is completed, the paper P will undergo automatic loading. Specifically, upon actuation of the transfer apparatus, the free end portion (leading portion) of the paper P is automatically sent to the discharge roller 16 owing to a controlling unit, guiding members and the like which are not shown. After the free end portion of the paper P is held between the discharge roller and the pinch roller 17, the user can start the printing operation.

Figure 8:
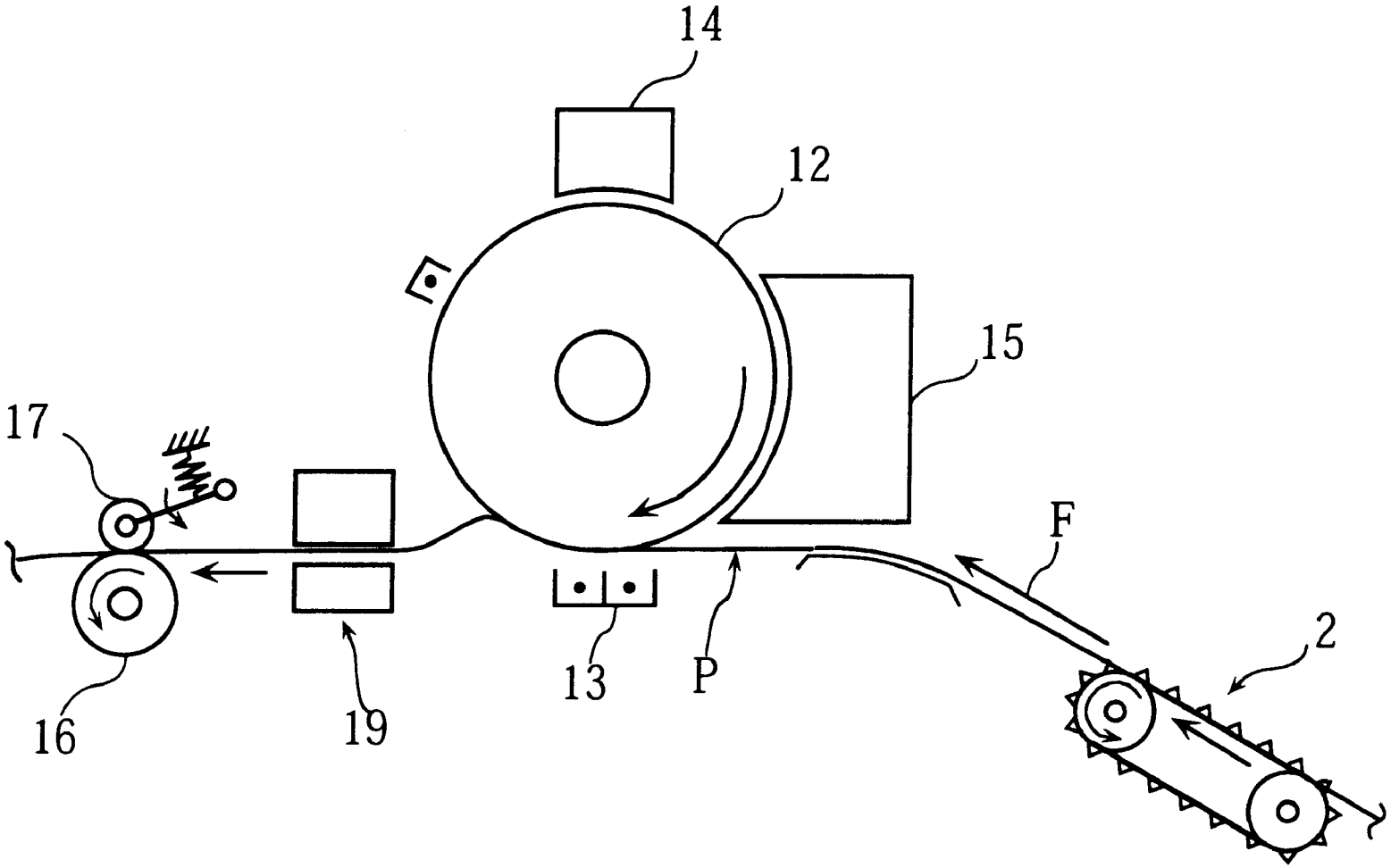
FIG. 8 illustrates problems accompanied by a conventional paper transfer apparatus.

During the printing operation, the paper P may be transferred along the transfer path at high speed. In such an instance, if no appropriate countermeasures are taken, the elongated paper P may unduly stick to the drum 12 and deviate from the predetermined transfer path, as previously described with reference to FIG. 8. When this happens, the feed holes Pa of the paper P may be broken or prematurely come out of engagement with the projection 22.

According to the present invention, the transferred paper P is arranged to receive a braking force from the presser members 4*b* of the respective tractors 2. Thus, even when a relatively thin paper is used, the paper will not prematurely come off the tractors 2, or the feed holes Pa of the paper P will not be broken. Here, it should be noted that the braking force does not lessen the driving power of the tractors 2. In fact, the braking force is used only to cancel out the pulling force generated by the elongated paper's unfavorable sticking to the photosensitive drum 12.

According to the present invention, the presser member 4*b* is formed with the inclined grooves 45 (FIG. 6). With such an arrangement, as the paper P is moved in the transferring direction F, the paper P is properly stretched widthwise, so that the paper P is prevented from sagging. As a result, the paper P will come into proper contact with the photosensitive drum 12.

The braking force applied to the paper P by the presser member 4*b* is adjusted in various ways. For instance, in the illustrated embodiment, the presser member 4*b* and the lid body 4*a* are separately prepared from each other, and the former is connected to the latter by the screwing means 43. In this arrangement, by operating the screwing means 43, the presser member 4*b* can be moved away from or toward the lid body 4*a*. Clearly, as the presser member 4*b* is spaced farther from the tractor lid, the braking force by the presser member will become stronger. On the other hand, as the presser member 4*b* is moved toward the lid body 4*a*, the braking force by the presser member will become weaker.

The lower surface of the presser member 4*b* may be formed with a suitable number of bumps or recesses. In this way, the friction between the presser member 4*b* and the paper P is varied. Alternatively, by replacing the presser member 4*b* with another presser member made of a different material, the friction between the presser member and the paper can be also varied.

Further, in the preferred embodiment, the tractor lid 4 is urged toward the paper supporting surface 31 by the spring 42, as shown in FIG. 3A. Thus, by replacing the spring 42 for another spring having a different spring constant, the braking force applied to the paper P can be varied.

Figure 3B:
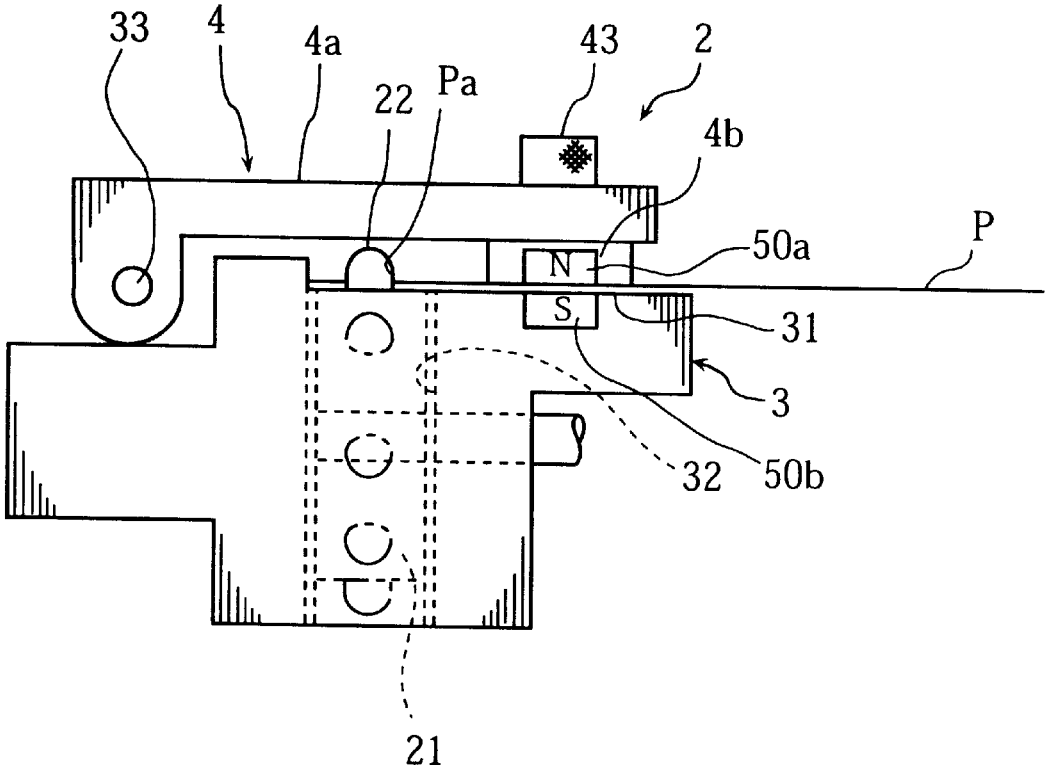
FIG. 3B illustrates a modified arrangement for urging a tractor lid toward a support base of the tractor.

Further, by changing the weight of the traction lid 4, the braking force can be varied. Still further, as shown in FIG. 3B, use may be made of a pair of magnets 50*a*, 50*b* for causing the presser member 4*b* to be urged toward the paper supporting surface 31. To this end, one magnet 50*a* is embedded in the presser member 4*b*, while the other magnet 50*b* is embedded in the paper supporting surface 31 in facing relation to the first magnet 50*a*. In this instance, by adjusting the magnetic force of the magnets 50*a*, 50*b*, the braking force applied to the paper P can be varied.

Instead of using two magnets 50*a*, 50*b*, only one of them (the magnet 50*a*, for example) may be used, and the other magnet may be replaced with a suitable metal plate made of a magnetic material such as iron.

Figure 7:
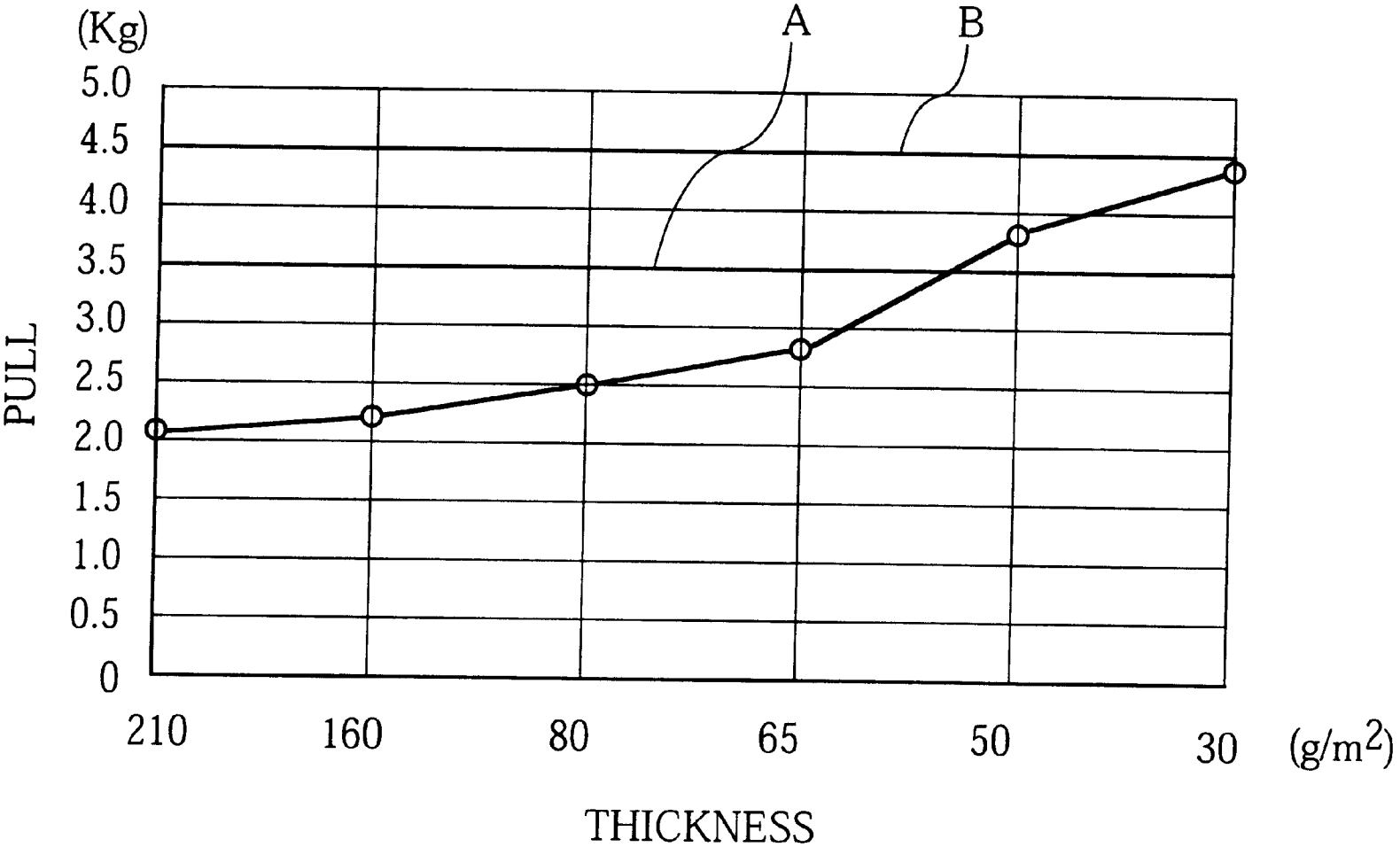
FIG. 7 is a graph showing a relationship between the thickness of paper and the pull applied to the paper.

Reference is now made to FIG. 7 showing a graph which illustrates a relationship between the thickness of recording paper and the pulling force applied to the paper. This graph includes an abscissa for representing the thickness of paper and an ordinate for representing the pull applied to the paper transferred. The thickness of paper is expressed in weight of paper (gram) per square meter. By this expression, the thickness of the paper decreases as the values put below the abscissa decreases. The pull is caused by the discharge roller 16 and the photosensitive drum 12 to which the paper P unduly adheres due to corona discharge (as described with reference to FIG. 8). For properly transferring the paper P by the tractors 2, the paper needs to be applied with a braking force canceling out the pull. According to the graph, the pull is 2.8 kg for a paper having a standard thickness (65 g/m$^2$), while the pull is 3.8 kg for a thinner paper having a thickness of 50 g/m$^2$. For a much thinner paper having a thickness of 30 g/m$^2$, the pull is 4.4 kg.

A conventional paper transfer apparatus cannot properly transfer those thin papers (50 g/m$^2$ and 30 g/m$^2$). From this, it is assumed that the conventional paper transfer apparatus may be usable only when the pull is smaller than 3.5 kg (reference A in FIG. 7). However, in the paper transfer apparatus of the present invention, recording paper is properly transferred even when the pull is increased up to 4.5 kg (reference B).

The preferred embodiments of the present invention being thus described, it is obvious that the same may be varied in various ways. Such variations should not be regarded as a departure from the spirit and scope of the invention, and all such variations as would be obvious to those skilled in the art are intended to be included within the scope of the appended claims.

What is claimed is:

1. A paper transfer apparatus incorporated in an electrophotographic printer having a photosensitive drum for printing on elongated paper transferred along a transfer path extending via the photosensitive drum, the paper transfer apparatus comprising:

a discharge roller for pulling the elongated paper in a transferring direction, the discharge roller being spaced downstream from the photosensitive drum; and a traction mechanism for advancing the elongated paper along the transfer path, the traction mechanism being spaced upstream from the photosensitive drum;

wherein the traction mechanism is provided with braking means for applying variable friction to the elongate paper;

wherein the traction mechanism comprises at least one tractor which includes; a support base provided with an upper surface for supporting the elongated paper; front and rear pulleys rotatably supported by the support base; an endless belt held in engagement with the front and the rear pulleys, the endless belt being provided with a plurality of projections coming into engagement with feed holes of the elongated paper; and a tractor lid pivotably supported by the support base, the tractor lid being pivotable between an open position where the endless belt is exposed and a closed position where the tractor lid is held in facing relation to the endless belt; and wherein the braking means comprises a presser member supported by the tractor lid, the presser member being arranged to apply a predetermined pressing force to the elongated paper when the tractor lid is in the closed position.

2. The paper transfer apparatus according to claim 1, wherein the predetermined pressing force is caused by a weight of the tractor lid.

3. The paper transfer apparatus according to claim 1, wherein the tractor further comprises an elastic member bridging between the support base and the tractor lid, the predetermined pressing force being caused by the elastic member.

4. The paper transfer apparatus according to claim 1, wherein the tractor further comprises at least one magnet embedded therein, the predetermined pressing force being caused by the magnet.

5. The paper transfer apparatus according to claim 1, wherein the braking means is selectively brought into an operation state where friction is applied to the elongated paper and a non-operation state where friction is not applied to the elongated paper.

6. A paper transfer apparatus incorporated in an electrophotographic printer having a photosensitive drum for printing on elongated paper transferred along a transfer path extending via the photosensitive drum, the paper transfer apparatus comprising:

a discharge roller for pulling the elongated paper in a transferring direction, the discharge roller being spaced downstream from the photosensitive drum; and a traction mechanism for advancing the elongated paper along the transfer path, the traction mechanism being spaced upstream from the photosensitive drum and provided with braking means for applying friction to the elongated paper;

wherein the traction mechanism comprises a first and a second tractors each including: a support base provided with an upper surface for supporting the elongated paper; a front and a rear pulleys rotatably supported by the support base; an endless belt held in engagement with the front and the rear pulleys, the endless belt being provided with a plurality of projections coming into engagement with feed holes of the elongated paper; and a tractor lid pivotally supported by the support base, the tractor lid being pivotable between an open position where the endless belt is exposed and a closed position where the tractor lid is held in facing relation to the endless belt;

wherein the braking means comprises a first and a second presser members supported by the tractor lids of the first and second tractors, respectively, the first and second presser members being arranged to apply a predetermined pressing force to the elongated paper when the tractor lids are in the closed position; and wherein each of the first and the second presser members is formed with a plurality of grooves each having an inner end and an outer end opposite to the inner end, the inner end being closer to the other presser member than the outer end, the outer end being offset in the transferring direction with respect to the inner end.

7. A paper transfer apparatus incorporated in an electrophotographic printer having a photosensitive drum for printing on elongated paper transferred along a transfer path extending via the photosensitive drum, the paper transfer apparatus comprising:

a discharge roller for pulling the elongated paper in a transferring direction, the discharge roller being spaced downstream from the photosensitive drum; and a traction mechanism for advancing the elongated paper along the transfer path, the traction mechanism being spaced upstream from the photosensitive drum;

wherein the traction mechanism is provided with braking means including a presser member for applying friction to the elongated paper, the presser member being formed with a plurality of grooves each having an inner end and an outer end opposite to the inner end, said outer end being offset in the transferring direction with respect to said inner end.

8. A paper transfer apparatus incorporated in an electrophotographic printer having a photosensitive drum for printing on elongated paper transferred along a transfer path extending via the photosensitive drum, the paper transfer apparatus comprising:

a discharge roller for pulling the elongated paper in a transferring direction, the discharge roller being spaced downstream from the photosensitive drum; and a traction mechanism spaced upstream from the photosensitive drum and including a tractor for advancing the elongated paper along the transfer path, the traction mechanism being also provided with braking means including a presser member for applying friction to the elongated paper;

wherein the tractor includes a support base for supporting the elongated paper and a lid member supported by the support base, the lid member being pivotable between an open position and a closed position; and wherein the presser member is supported by the lid member and formed separately from the lid member, the presser member being adjustable in position with respect to the lid member.

* * * * *